US006648972B1

(12) United States Patent
Stober et al.

(10) Patent No.: US 6,648,972 B1
(45) Date of Patent: Nov. 18, 2003

(54) DEVICE FOR POWDERING PRINTED SHEETS WITH THE AID OF AN ELECTROSTATIC CHARGE

(75) Inventors: Thomas Stober, Urbach (DE); Reiner Haas, Metzingen (DE); Gunter Hess, Reutlingen (DE)

(73) Assignee: Weitmann & Konrad GmbH & Co., Leinfelden-Echterdingen (DE)

( * ) Notice: Subject to any disclaimer, the term of this patent is extended or adjusted under 35 U.S.C. 154(b) by 0 days.

(21) Appl. No.: 09/762,723

(22) PCT Filed: Jul. 10, 1999

(86) PCT No.: PCT/EP99/04864

§ 371 (c)(1),
(2), (4) Date: Feb. 9, 2001

(87) PCT Pub. No.: WO00/09337

PCT Pub. Date: Feb. 24, 2000

(30) Foreign Application Priority Data

Aug. 10, 1998 (DE) ..... 198 36 022

(51) Int. Cl.[7] ..... B05B 5/00

(52) U.S. Cl. ..... 118/621; 101/483; 427/475; 427/553; 427/595; 427/180; 427/421

(58) Field of Search ..... 118/621, 623–625, 118/638; 101/483, 489; 427/475, 551, 553, 500, 595, 180, 421

(56) References Cited

U.S. PATENT DOCUMENTS

| | | | | |
|---|---|---|---|---|
| 3,053,180 A | | 9/1962 | Doyle | 101/416 |
| 4,048,038 A | * | 9/1977 | Kunkle | 204/168 |
| 5,138,971 A | * | 8/1992 | Nakajima et al. | 118/624 |
| 5,784,957 A | * | 7/1998 | Rau et al. | 101/142 |
| 5,955,236 A | * | 9/1999 | Bower | 430/115 |

FOREIGN PATENT DOCUMENTS

| | | |
|---|---|---|
| DE | 21 51 185 | 4/1973 |
| DE | 29 36 754 | 4/1981 |
| DE | 31 35 220 | 3/1983 |
| DE | 32 17 779 | 11/1983 |
| DE | 32 29 035 | 1/1984 |
| DE | 44 27 904 | 2/1996 |
| DE | 196 09 438 | 9/1997 |
| DE | 296 23 325 | 4/1998 |

OTHER PUBLICATIONS

English Language Translation of German Patent No. 196 09 438 A1, Platsch, Sep. 1997.*

* cited by examiner

*Primary Examiner*—Richard Crispino
*Assistant Examiner*—Michelle Aewedo Lazor
(74) *Attorney, Agent, or Firm*—Young & Basile, PC

(57) ABSTRACT

The invention relates to a device for powdering printed sheets, especially printed sheets made out of paper, whereby a powder coating device is arranged inside a sheet feeding device and an electrostatic charging device that is disposed outside the sheet feeding device is assigned to the sheet.

16 Claims, 4 Drawing Sheets

DEVICE FOR POWDERING PRINTED SHEETS WITH THE AID OF AN ELECTROSTATIC CHARGE

BACKGROUND

The invention relates to a device for powdering printed sheets of paper or similar material by means of a powdering device, which is located inside a sheet delivery mechanism, where a charging device is assigned to the sheet for electrostatic charging.

In DE 44 27 904 A1 powdering equipment is disclosed with which powder is electrostatically charged before it is blown onto a printed paper sheet. Electrostatically charged powder certainly adheres better to paper sheets, but its adhesive strength needed to be improved. In DE 29 36 754 A1 a device is disclosed for the electrostatic application of material particles transported in a stream of gas onto a paper sheet. In this process, an electrical field is generated in the vicinity of the sheet of paper, into which the material particles, in particular, powder, is blown. As a result of the field lines, the powder is guided onto the surface of the material web.

With DE 31 35 220 A1 a device for applying powder particles onto printed sheets of paper is disclosed in which the sheet is electrostatically charged on the side which is not to be powdered. This certainly has the advantage that the charging rods can be located relatively close to the sheet of paper, but the sheet of paper itself acts as an insulator. Locating the charging rod on the opposite side, i.e. the side of the sheet of paper to be powdered is possible, but the charging rod can only be located at a relatively long distance from the sheet, since space must be kept clear for the rapidly moving gripper.

SUMMARY

The object of the invention, therefore, is to provide a device with which the printed sheet can be better powdered.

This object is met under the invention by locating the charging device outside the sheet delivery mechanism at a location before the sheet enters the sheet delivery mechanism.

This has the considerable advantage that the charging device can be positioned relatively close to the printed surface, because no clear space has to be created for any rapidly moving grippers. The grippers are located inside the sheet delivery mechanism, whereas the charging device is located outside the sheet delivery mechanism and, thus, the most suitable position can be selected. In addition, it has also been shown that electrostatic charging of the printed side of the sheet is more advantageous than charging the opposite side, i.e. the side which is not to be powdered.

Under the invention then, a part of the powdering process, which includes the electrostatic charging of the sheet of paper, is moved outside the sheet delivery mechanism. The application of the powder, however, continues to take place in the delivery mechanism. As a result of the immediate proximity of the charging device to the surface of the sheet to be powdered, small concentrated fields can be generated and act upon the sheet of paper, and because of the short distances, the field strength and thus the electrostatic charge can be adjusted precisely without any discharge resulting.

A further embodiment provides for the charging device to be designed as a charging rod. Firstly, this charging rod can be adjusted relatively easily to the paper quality, secondly, the distance of the charging rod to the adjacent surface of the web can be adjusted with great precision. In addition, the charging rod can be replaced without difficulty, for example, for repair and/or maintenance purposes.

Under a preferred example of the embodiment, the intended position of the charging device is in the area of the last pressure roller, viewed in the direction of transportation, of a rotary offset press. This has the considerable advantage that the web is held by the pressure roller and no gripper is needed either for holding or for transporting the sheet in this area, so that the charging device can be positioned relatively close to the sheet of paper. The charging device is immediately opposite the pressure roller. This means that the sheet of paper is located between the pressure roller and the charging device.

The best results are achieved when the intended position of the charging device is immediately ahead of the separation point from the pressure roller. In this case the sheet is released from the pressure roller immediately after it is electrostatically charged, so that no charge can drain off through the pressure roller.

In the example of one embodiment provision is made for positioning one or several ionization rods ahead of the charging rod. These ionization rods are used to discharge or to prepare the sheet, respectively, prior to charging by means of the charging rod. The ionization rods are supplied with alternating current (about 6.5 kV) and are used principally for actively discharging the sheet or the surface of the sheet. The charging rod on the other hand is operated with direct current (about 12 kV).

The pressure roller is preferably made from an electrically conductive material, for example, metal, and is grounded. The charging device, in particular the charging rod, is positively charged, or emits positive ions. This construction has the considerable advantage that one side of the sheet of paper can be grounded and, for example, the positive ions can be applied on the other side of the sheet of paper, and that negatively charged powder can be used.

It is preferable that there is no relative motion during charging between the sheet and the pressure roller, or ground. This allows an unhindered discharge of negative ions through ground. In addition, charging is not interrupted, because the sheet and ground are motionless relative to one another.

Then, for example, either electrostatically negatively charged powder or uncharged powder is applied to the electrostatically charged sheet. In the case of electrostatically charged powder, the powder has the opposite charge for charging the printed surface of the sheet of paper.

The powdering device can be positioned advantageously ahead of a sheet unroller. In general, the powdering device can be positioned ahead of the drying section. In any case, the powdering device is intended to be positioned ahead of a sheet braking device, so that when the sheet is braked it is already dusted with powder.

An additional advantage is also seen in the fact that the sheet is essentially being guided on cushions of air after it is separated from the pressure roller. In this way, any draining of the charge is prevented or at least delayed.

The charging device generates an electrostatic field matched to the width of the sheet, where the field can be adapted to the width of the sheet. In this way, when narrow sheets are being processed, damage to the pressure roller, for example, or to other pieces of machinery can be prevented.

Additional advantages, characteristics and details of the invention can be seen from the dependent claims and also from the following description, in which a particularly preferred embodiment is shown in detail, with reference to the drawing. In it the characteristics shown in the drawing and set forth in the claims and the description can be essential to the invention in each case individually or in any combination.

DETAILED DESCRIPTION

Figure 1:
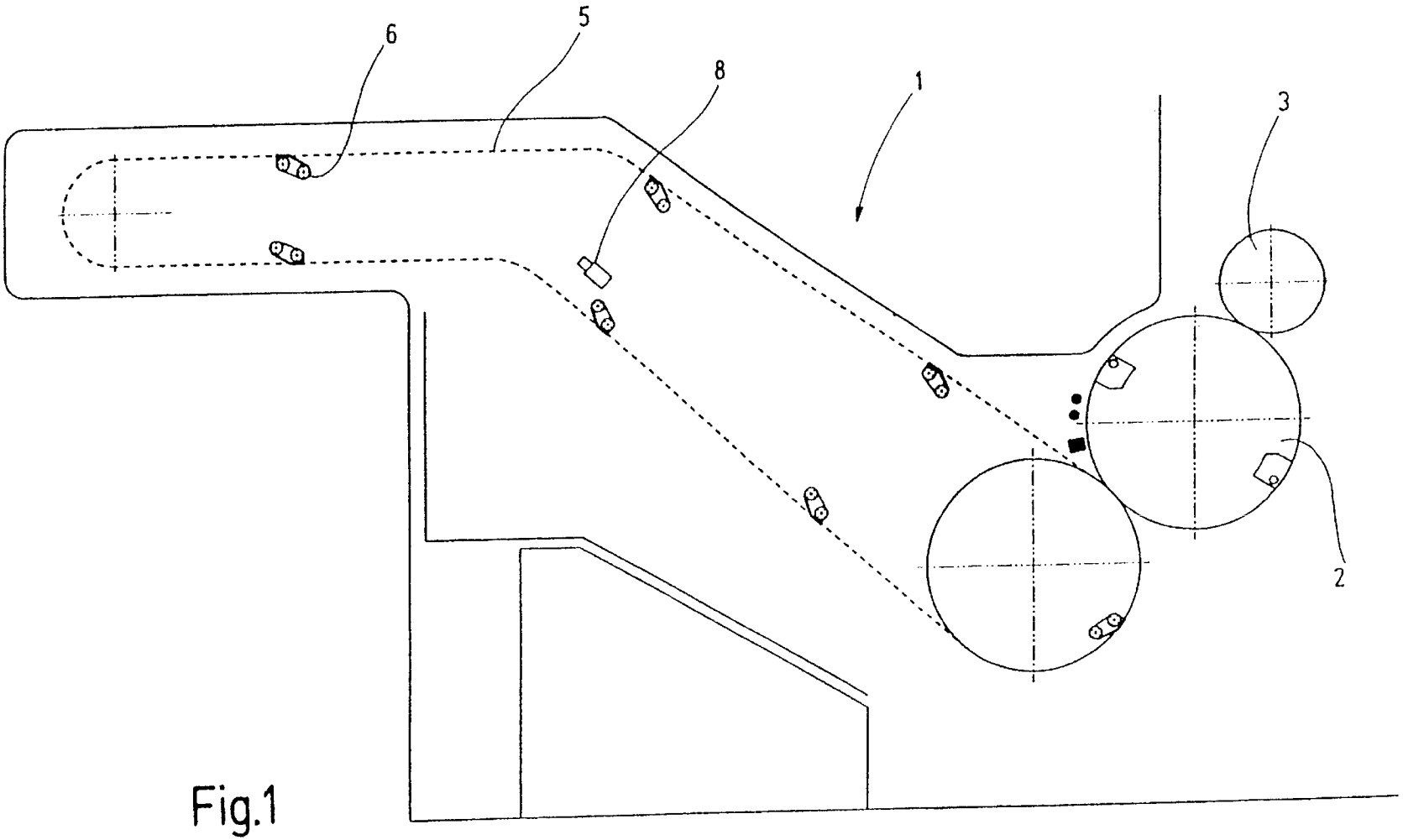
FIG. 1 is a schematic view of a sheet delivery mechanism which is attached to the end of a rotary offset press.
Figure 2:
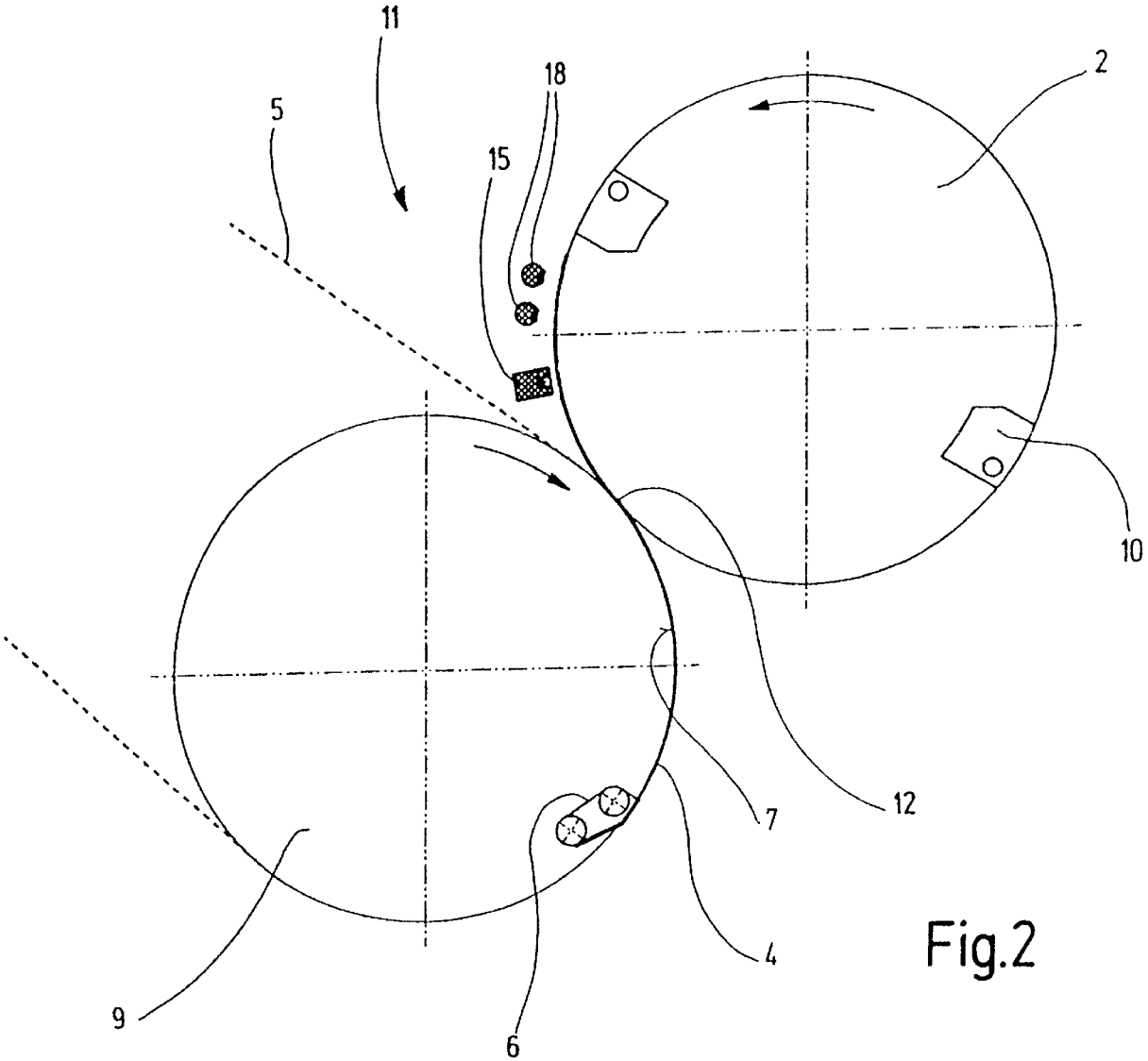
FIG. 2 is an enlarged view of the transfer station from the rotary offset press to the delivery mechanism.

In FIG. 1, reference number 1 indicates a sheet delivery mechanism which attaches to the last pressure roller 2 of a printer which, while not shown, is, for example, a rotary offset press. Part of this rotary press is a blanket cylinder 3 with which the printing ink is transferred onto a sheet of paper 4 (FIG. 2), which is being transported through and between the pressure roller 2 and the blanket cylinder 3. The sheet feeder 1 serves the purpose of stacking the printed sheets of paper 4 coming from the printer in a pile. To do this, the sheet delivery mechanism 1 comprises in a known way two endless chain grippers 5 positioned equidistant, which are connected by transverse gripper bars. The length of these gripper bars measured perpendicular to the plane of the drawing in FIG. 1, and thus the distance between the two gripper bars 5, only one of which is shown in FIG. 1, is approximately equal to the width of the sheets of paper 4 to be stacked. Each gripper bar has a gripper 6, which holds the sheet of paper 4 to be transported at its forward edge, as shown in FIG. 2. The sheets of paper 4 are moved along by the grippers 6 in such a way that the printed side of the sheet 7 (FIG. 2) faces the gripper 6, so that it is facing upwards in the stack.

In order to facilitate drying of the printed sheet of paper 4 in the stack (not shown) and prevent smearing of the still damp ink when the sheets are being stacked on top of one another in the pile, the printed sheets 4 have to be coated with powder before they are deposited. To do this, the sheet delivery mechanism 1 has a powder coating device 8, which is shown only schematically in FIG. 1. With this powder coating device 8, powder is blown onto the sheet of paper 4 being transported past. The powdering device 8 is at a distance from the sheet of paper 4 sufficient to allow the gripper 6 to travel past. This distance can be up to 15 cm.

The pressure roller 2 and a guide roller 9 for the gripper chain 5 is shown in FIG. 2. The sheet of paper 4 is held firmly against the pressure roller during the printing process by means of retaining elements 10, where the retaining elements 10 are an integral part of the pressure roller 2. A short distance from the printed side 7 of the sheet of paper 4 is a charging device 11, which lies opposite the pressure roller 2. In addition, the charging device 11 is positioned immediately ahead of the release point 12, where the sheet of paper 4 is lifted from the pressure roller 2 and transported by the gripper 6 into the sheet delivery mechanism 1. Since no elements are projecting beyond the surface of the pressure roller 2, the charging device 11 can be positioned a very short distance from the surface of the pressure roller 2, or to the printed side 7 of the sheet of paper 4, respectively.

In the case of the embodiment shown in FIG. 2, the charging device 11 consists of a charging rod 15 and two ionization rods 18, which are located ahead of the charging rod in order to discharge the sheet 4, or to prepare it for charging respectively.

Figure 3:
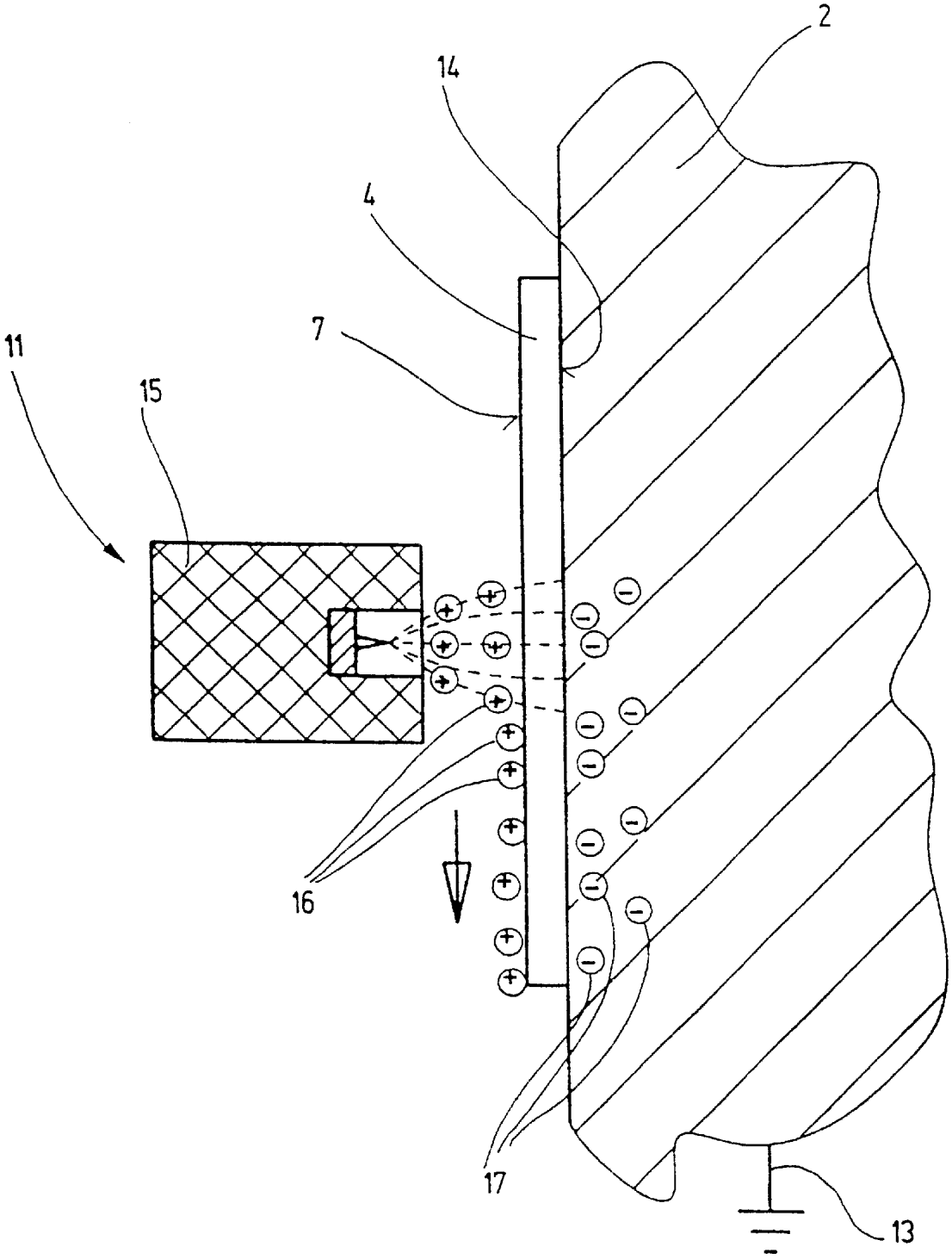
FIG. 3 is a section of the pressure roller with a sheet of paper during the electrostatic charging.

FIG. 3 shows a section of the pressure roller 2 on which the sheet of paper 4 is lying. The pressure roller 2 is grounded at 13. The pressure roller 2 consists in addition of an electrically conductive material, so that the side of the sheet 14 opposite the printed side of the page 7 is grounded over its surface. The charging rod 15 can also be seen in FIG. 3. This charging rod 15 emits, for example, positively charged ions 16 in the direction of the sheet of paper 4 running past. These positive ions 16 are deposited on the printed side of the sheet 7, whereas negative ions 17 accumulate on the unprinted side of the sheet 14.

Figure 4:
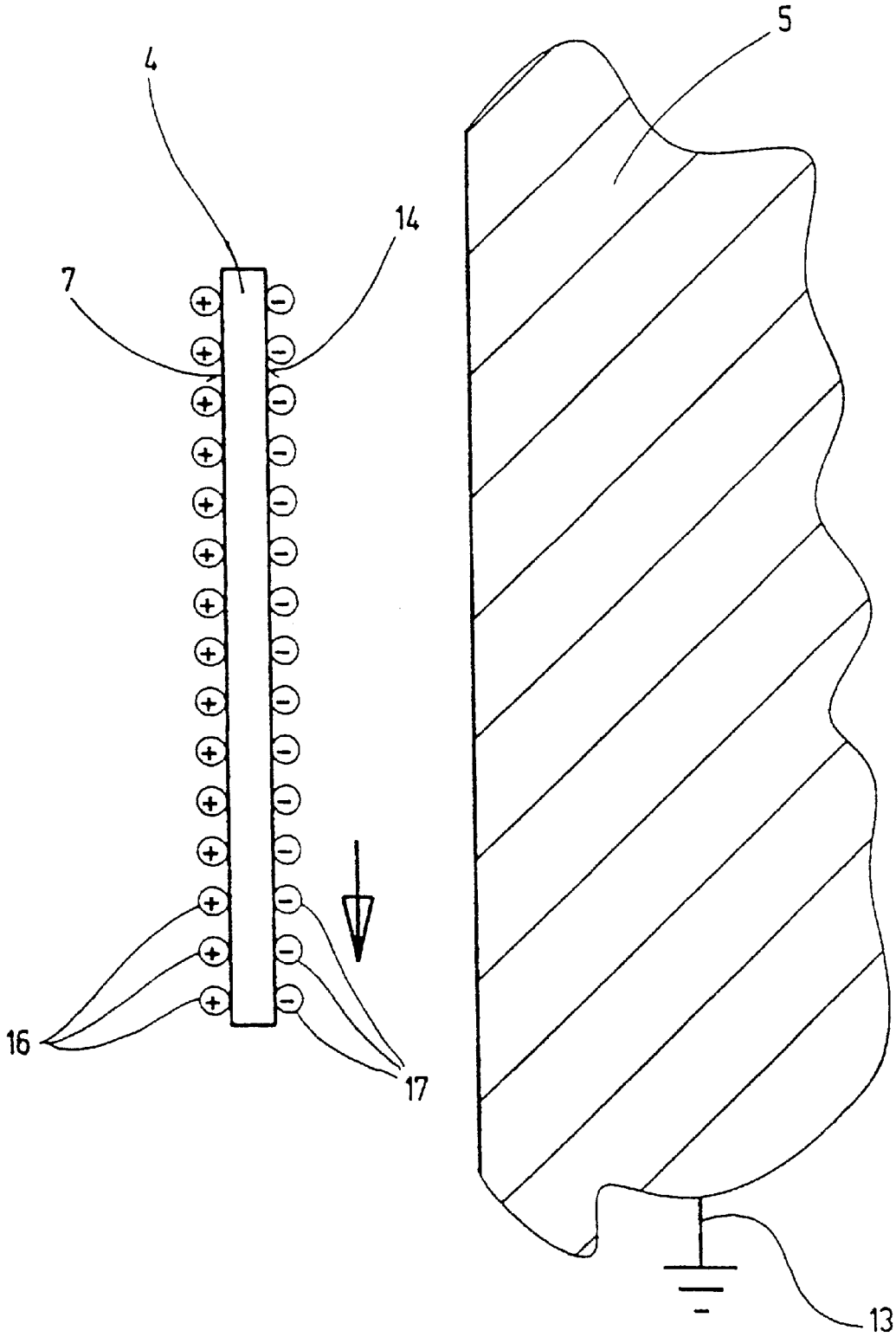
FIG. 4 is a section of the pressure roller and the sheet of paper after charging.

FIG. 4 shows the sheet of paper 4 immediately after the separation point 12, i.e., after it separates from the pressure roller 2. The two sides of the sheet 7 and 14 are carrying the positive ions 16 or the negative ions 17, respectively. This sheet of paper 4 is now transported by the gripper 6 in the direction of the powdering device 8, where the powder, which can be negatively charged, is blown onto it. But it is also conceivable that uncharged powder can be used.

It is regarded as an advantage that while it is being electrostatically charged, the entire surface of the sheet of paper 4 preferably lies against the pressure roller 2, which for its part is grounded. In this way, the entire unprinted side of the sheet 14 is grounded while it is being electrostatically charged. Since the charging device 11 is positioned in close proximity to the printed side of the sheet, optimal orientation of the electrical field and a precise adjustment of field strength can be ensured. Since the sheet of paper 4 is separated from the pressure roller 2 immediately after it has been electrostatically charged, the charge is carried with it before it is neutralized or drains off.

With the device as envisaged by the invention, the powder can be applied with less waste and greater accuracy to the sheet of paper 4.

What is claimed is:

1. A device for powdering printed sheets by means of a power coating device, which is positioned inside a sheet delivery mechanism, whereby a charging device is allocated to the sheet to electrostatically charge it, characterized in that the charging device is provided outside the sheet delivery mechanism in a location before the sheet enters the sheet delivery mechanism and is adjacent to the printed side of the sheet, characterized in that the charging device is positioned in the area of the last pressure roller of a rotary offset press, viewed in the direction of transportation of the sheet.

2. The device in accordance with claim 1, characterized in that the charging device is formed as a charging rod.

3. The device in accordance with claim 2, characterized in that at least one ionization rod is positioned ahead of the charging rod.

4. The device in accordance with claim 1, characterized in that the charging device is positioned in immediate proximity to the printed side of the sheet.

5. The device in accordance with claim 1, characterized in that the pressure roller is made of metal and is grounded, and the charging device is one of positively charged and emits positive ions.

6. The device in accordance with claim 1, characterized in that the sheet is grounded when it is electrostatically charged.

7. The device in accordance with claim 1, characterized in that there is no motion between the sheet relative to ground when it is being electrostatically charged.

8. The device in accordance with claim 1, characterized in that one of electrostatically charged and uncharged powder is applied to the sheet.

9. The device in accordance with claim 1, characterized in that the powdering device is positioned in front of a sheet unroller.

10. The device in accordance with claim 1, characterized in that the powdering device is positioned ahead of a drying section.

11. The device in accordance with claim 1, characterized in that the powdering device is positioned ahead of a sheet braking device.

12. The device in accordance with claim 1, characterized in that the sheet is essentially guided on air cushions after it is separated from the pressure roller.

13. The device in accordance with claim 1, characterized in that the charging device emits an electrostatic field adjusted to a width of the sheet.

14. The device in accordance with claim 13, characterized in that the field is adjustable to the width of a sheet.

15. A device for powdering printed sheets by means of a power coating device, which is positioned inside a sheet delivery mechanism, whereby a charging device is allocated to the sheet to electrostatically charge it, characterized in that the charging device is provided outside the sheet delivery mechanism in a location before the sheet enters the sheet delivery mechanism and is adjacent to the printed side of the sheet, further characterized in that the charging device is positioned in the area of the last pressure roller of a rotary offset press, viewed in the direction of transportation of the sheet, characterized in that the charging device is positioned opposite the pressure roller.

16. A device for powdering printed sheets by means of a power coating device, which is positioned inside a sheet delivery mechanism, whereby a charging device is allocated to the sheet to electrostatically charge it, characterized in that the charging device is provided outside the sheet delivery mechanism in a location before the sheet enters the sheet delivery mechanism and is adjacent to the printed side of the sheet, further characterized in that the charging device is positioned in the area of the last pressure roller of a rotary offset press, viewed in the direction of transportation of the sheet, characterized in that the charging device is positioned immediately before a separation point of the sheet from the pressure roller.

* * * * *